US005357770A

United States Patent [19]

Lanyi

[11] Patent Number: 5,357,770

[45] Date of Patent: Oct. 25, 1994

[54] JEWELRY WITH INTERCHANGEABLE ORNAMENTAL MEMBERS

[76] Inventor: Carolyn H. Lanyi, 3299 Bloomfield Park Dr., West Bloomfield, Mich. 48323

[21] Appl. No.: 79,211

[22] Filed: Jun. 18, 1993

Related U.S. Application Data

[63] Continuation of Ser. No. 866,842, Apr. 10, 1992, abandoned.

[51] Int. Cl.[5] ..... A44C 17/02

[52] U.S. Cl. ..... 63/29.1

[58] Field of Search ..... 63/29.1, 15

[56] References Cited

U.S. PATENT DOCUMENTS

| | | | |
|---|---|---|---|
| 3,399,547 | 9/1968 | Spielman et al. | 63/15 |
| 3,688,520 | 9/1972 | Strassel | 63/29.1 |
| 4,309,879 | 1/1982 | Gretz et al. | 63/29.1 |
| 4,393,667 | 7/1983 | Reinstein et al. | 63/29.1 |
| 5,076,072 | 12/1991 | Payne | 63/29.1 |

FOREIGN PATENT DOCUMENTS

| | | | |
|---|---|---|---|
| 493421 | 3/1930 | Fed. Rep. of Germany | 63/29.1 |
| 1003167 | 3/1952 | France | 63/15 |
| 1427044 | 12/1965 | France | 63/29.1 |
| 803032 | 10/1958 | United Kingdom | 63/29.1 |

*Primary Examiner*—Michael J. Milano
*Attorney, Agent, or Firm*—Alex Rhodes

[57] ABSTRACT

An article of jewelry comprising a setting and an ornamental member detachably mounted on the setting. The ornamental member has a base and a decorative stone mounted on the base. Extending outwardly from the base is an elongated slender portion for retaining the ornamental member to the setting. On the setting there is an aperture for receiving the elongated retaining portion. In one aspect of the invention the retaining portion has an inner locating portion which is unitarily formed with the base and a separate outer locking member which is rotatably attached to the locating portion. When the retaining portion is inserted into the aperture, the locating portion lies within the aperture and the locking portion extends outwardly from the setting. The ornamental member is fixedly mounted on the setting by inserting the retaining portion into the setting and rotating the locking member to block the removal of the ornamental member from the setting. In a second aspect of the invention, the outer locking portion is unitarily formed with the inner locating portion and the ornamental member is fixedly mounted on a setting by inserting the unitary retaining portion into the aperture and bending the outward extending locking portion to block the removal of the ornamental member from the setting.

14 Claims, 4 Drawing Sheets

JEWELRY WITH INTERCHANGEABLE ORNAMENTAL MEMBERS

This is a continuation of co-pending application Ser. No. 07/866,842 filed on Apr. 10, 1992, now abandoned.

BACKGROUND OF THE INVENTION

This invention relates to articles of jewelry with interchangeable ornamental members and more particularly to an article of jewelry, by way of example, a ring, bracelet, earring, or necklace with an easy to manufacture, easy to use detachable ornamental member. High prices of gold, silver and platinum settings have created a market for jewelry with detachable ornamental members whereby expensive settings can be used with a variety of ornamental members, such as gemstones, insignia, cameos, and monograms.

The following patents are exemplary of prior developments in this field of inventive endeavor:

| U.S. Pat. Nos.: | Issued |
|---|---|
| 3,543,535 | Dec. 1, 1970 |
| 3,635,047 | Jan. 18, 1972 |
| 3,653,227 | Apr. 4, 1972 |
| 3,693,376 | Sept. 26, 1972, |
| 3,933,011 | Jan. 20, 1976 |
| 4,305,262 | Dec. 15, 1981 |
| 4,488,415 | Dec. 18, 1984 |
| 4,742,696 | May 10, 1988 |
| 4,796,442 | Jan. 10, 1989 |
| 4,905,482 | Mar. 6, 1990 |

The jewelry in the prior art having detachable ornamental members are either mechanically complicated, lack a secure means for retaining the members on their settings or are difficult to use. Another aspect is that it is often limited to specific jewelry styles. Another aspect is that it is often difficult to manufacture.

With the preceding in mind, it will be later appreciated that the present invention provides weighty advantages and benefits heretofore unavailable.

SUMMARY OF THE INVENTION

The present invention is an article of jewelry with a detachable ornamental member. The jewelry comprises a setting which is adapted to be worn by a person and an ornamental member detachably mounted on the setting, the article being particularly but not exclusively in the form of a ring, a bracelet, earring or a necklace. The setting has an aperture for receiving a slender retaining portion of the ornamental member. The ornamental member is either unitarily formed or includes a base and an article of adornment, such as a gemstone or cameo separate from and attached to the base. One advantage of the invention is that a variety of decorative articles can be interchanged on a common expensive gold, silver, platinum, or like setting. Thus the same setting can be used on different occasions for such purposes as displaying a school insignia, a birthstone or gemstone.

In a preferred embodiment of the invention the ornamental member has a slender outward extending retaining portion which extends through the aperture for fixedly mounting the member on the setting. The retaining portion has an inner locating portion which lies within the aperture when the ornamental member is fixedly mounted on the setting and a separate outer locking member rotatably mounted to the locating portion. The locking member lies entirely outside of the aperture when the ornamental member is fixedly mounted on the setting.

The ornamental member is fixedly mounted on the setting by inserting the retaining portion through the aperture and rotating the locking portion to block the removal of the ornamental member from the setting.

One feature of the invention is that when a ring which embodies the invention is mounted on a finger, the retention of the ornamental member to the setting is further assured because the locking portion is trapped between the setting and the finger.

In a second embodiment of the invention the locking member is unitarily formed with the locating portion and is selectively bendable to fixedly mount the ornamental member on the setting or to remove the ornamental member from the setting. Thus it is seen that with either embodiment, the ornamental member is fixedly mounted on the setting by inserting a slender retaining portion through the setting and rotating an outer locking portion to block the removal of the ornamental member from the setting.

Further benefits and features of the invention will be apparent from the ensuing description and accompanying drawings which describe the invention in detail. A preferred embodiment is disclosed in accordance with the best mode which is contemplated for practicing the invention and the specific features in which exclusive property rights claimed are set forth in the numbered claims which are appended to the detailed description.

DETAILED DESCRIPTION OF THE PREFERRED EMBODIMENTS

Figure 7:
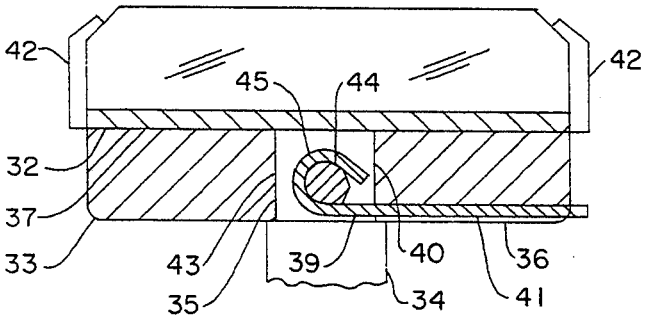
FIG. 7 is a fragmentary portion of FIG. 6 drawn to an enlarged scale.
Figure 1:
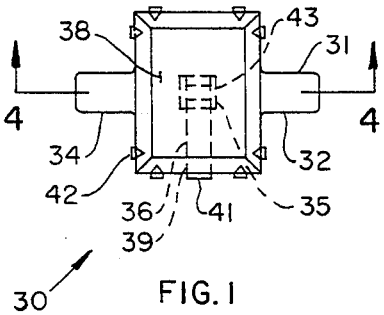
FIG. 1 is a plan view of a ring with a detachable ornamental member.
Figure 3:
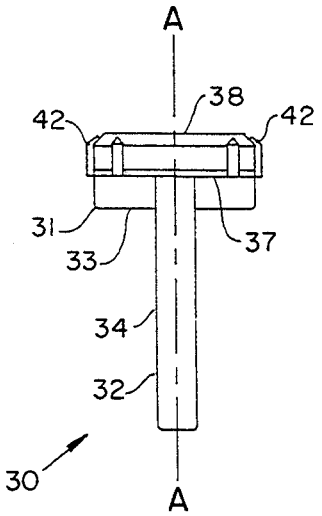
FIG. 3 is a right side view of the ring, shown in FIGS. 1 and 2.
Figure 2:
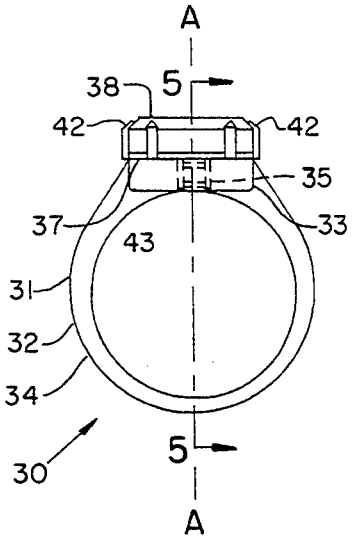
FIG. 2 is a front view of the ring of FIG. 1.

Referring now to the drawings wherein like numerals designate like and corresponding parts throughout the several views, in FIGS. 1 through 11, inclusive, a ring, generally designated by the numeral 30, is illustrated which embodies the present invention. The ring 30 has a setting 31 and an ornamental member 32 which is detachably mounted on the setting 31. The setting 31 and ornamental member 32 are separately shown in FIGS. 8 and 9 and in FIGS. 10 and 11 respectively. The setting has a substantially flat upper portion 33 and an adjoining arcuate lower portion 34. The setting 31 is preferably made from a rigid material, e.g., gold, silver, platinum, bone or wood.

An aperture 35 extends through the upper flat portion 33 and has an axis A—A which defines a reference line to which other features of the invention will be later related. The reference axis A—A is preferably but not necessarily perpendicular to the flat upper portion 33. The aperture 35 is rectangular to prevent the ornamental member 32 from rotating on the setting 31. At the bottom surface of the flat portion 33 there is a narrow recess 36. The recess 36 is perpendicular to the reference axis A—A and extends from the front face of the setting 31 to the aperture 35. The purpose of the recess 36 will be later understood.

Figure 10:
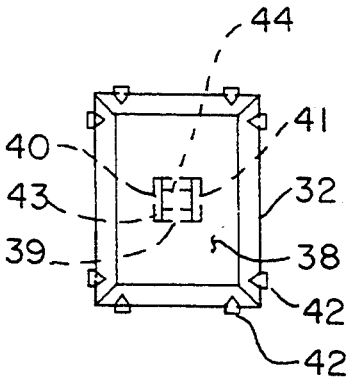
FIG. 10 is a plan view of the ornamental member of the ring shown in FIGS. 1–3.
Figure 8:
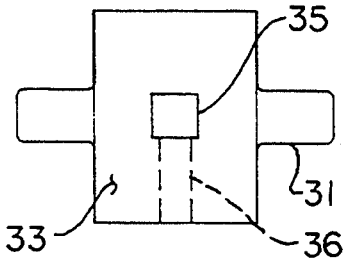
FIG. 8 is a plan view of the setting of the ring shown in FIGS. 1–3.
Figure 11:
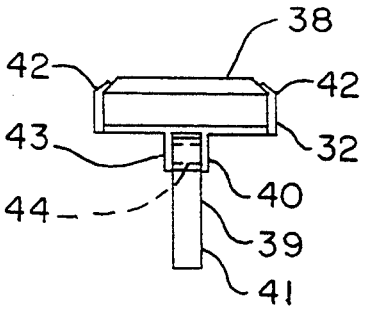
FIG. 11 is a front view of the ornamental member of the ring shown in FIGS. 1–3.
Figure 9:
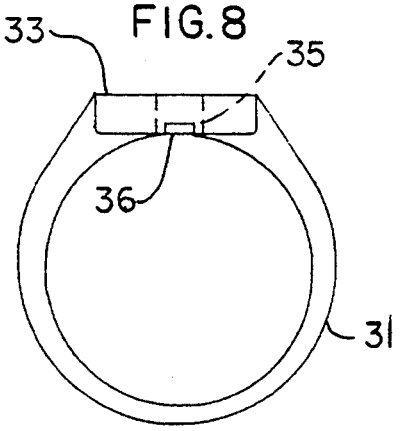
FIG. 9 is a front view of the setting of the ring shown in FIGS. 1–3.
Figure 12:
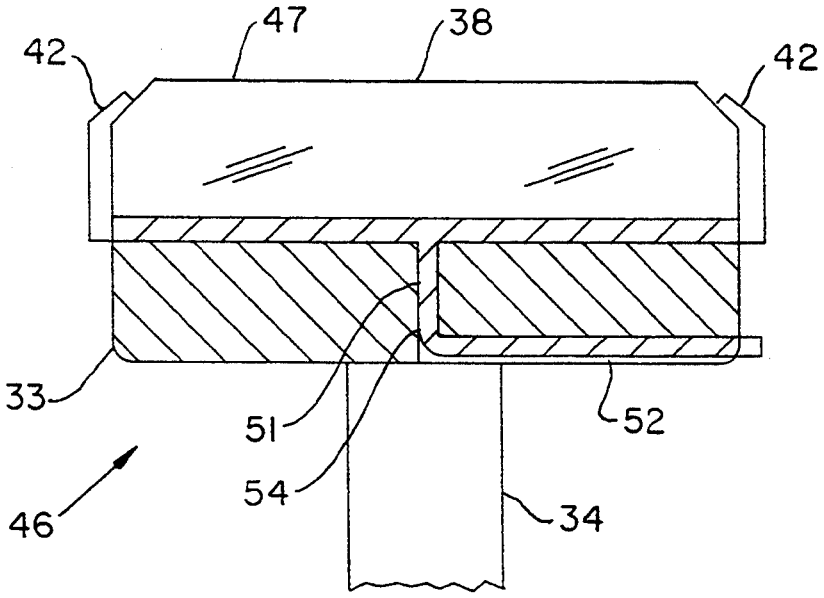
FIG. 12 is a fragmentary view which is similar to FIG. 7, showing an alternate embodiment of the ring.
Figure 13:
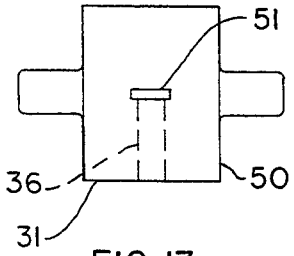
FIG. 13 is a top view of the setting alone of the alternate embodiment of FIG. 12.
Figure 14:
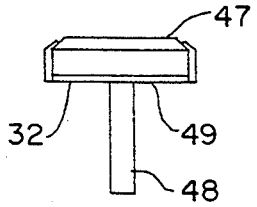
FIG. 14 is a plan view of the ornamental member alone of the alternate embodiment of FIG. 12.
Figure 15:
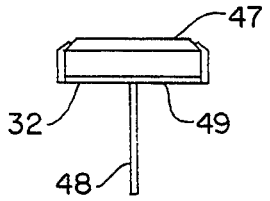
FIG. 15 is a front view of the ornamental member alone of the alternate embodiment of FIG. 12.
Figure 18:
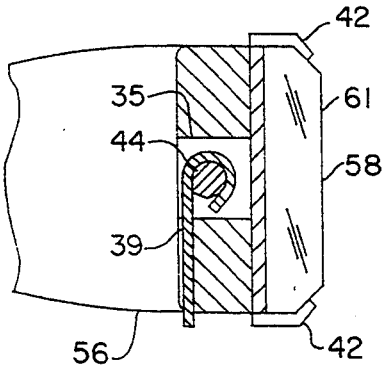
FIG. 18 is a fragmentary cross-sectional view, drawn to an enlarged scale, taken on the line 18—18 of FIG. 16.
Figure 16:
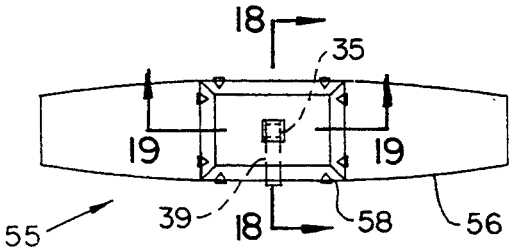
FIG. 16 is a plan view of a bracelet with a detachable ornamental member.
Figure 19:
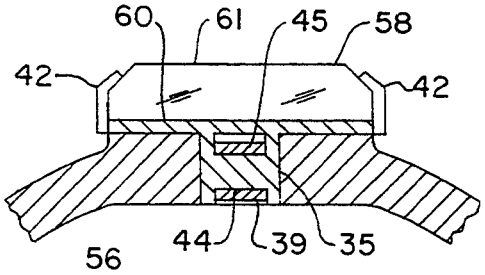
FIG. 19 is a fragmentary cross-sectional view, drawn to an enlarged scale, taken on the line 19—19 of FIG. 16.
Figure 17:
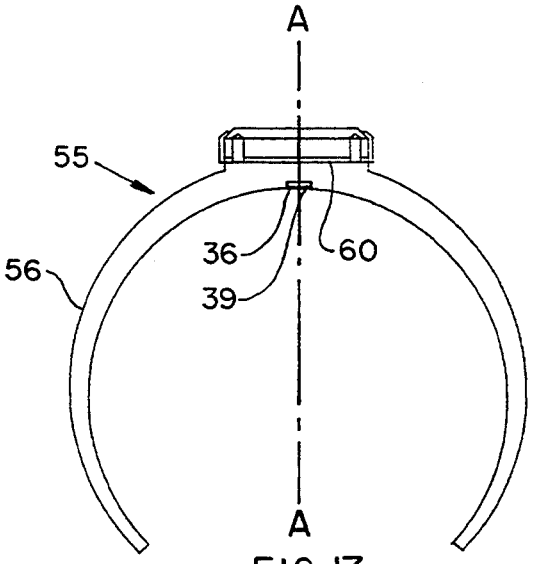
FIG. 17 is a front view of the bracelet.
Figure 22:
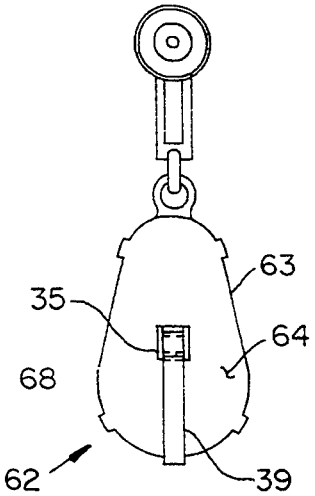
FIG. 22 is a rear view of the earring.
Figure 21:
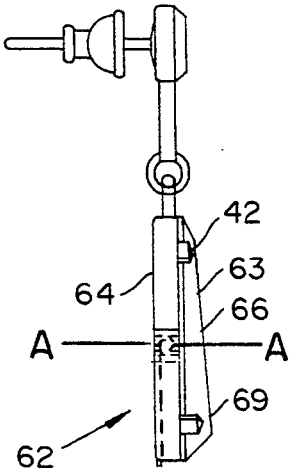
FIG. 21 is a right side view of the earring.
Figure 20:
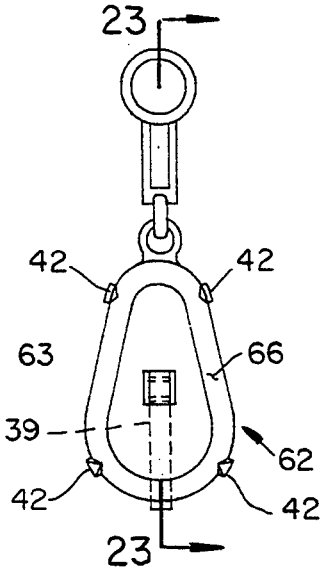
FIG. 20 is a front view of an earring with a detachable ornamental member.

Referring now to FIGS. 10 and 11, the ornamental member 32 comprises a base 37, a rectangular gemstone 38 mounted on the base 37 and an outward extending multi-piece portion 39 for fixedly retaining the ornamental member 32 on the setting 31. The retaining portion 39 has an inner locating portion 40 which is unitarily formed with the base 37 and an outer locking portion 41 which is rotatably attached to the inner locating portion 40. Extending upwardly from the base 37 are prongs 42 which retain the gemstone 38 on the base 37. The configuration of the inner locating portion 40 is best understood by reference to FIGS. 4 and 7. The inner locating portion 40 is comprised of a pair of spaced apart downward extending flanges 43 and a spindle 44 between the flanges 43. The flanges 43 and spindle 44 are shown unitarily formed with the base 37 but may be separate members, attached by a conventional means, such as silver soldering. The base 37 is preferably made of metal, such as gold, silver, platinum or the like.

The outer locking member 41 is shown in FIGS. 7 and 11. It is preferably a thin strip of a resilient corrosion resistent metal, such as a stainless spring steel, with an open loop end portion 45. The two downward extending flanges 43 of the locating portion 40, for the case under consideration, are parallel to the reference axis A—A. The width and the height of the flanges 43, as well as the space therebetween, are governed by the shape of the aperture 35 and the thickness of the flat portion 33 whereby the locating portion closely fits and lies within the aperture 35 when the ornamental member 32 is fixedly mounted on the setting 31.

The spindle 44 and loop end 45 of the outer locking member 41 are asymmetrical as shown in FIG. 7, to resiliency bias the locking member 41 within the recess 36 when the ornamental member 32 is fixedly mounted on the setting 31. When the locking member 41 is rotated on the spindle 44 from the locking position of FIG. 5, wherein the locking member is perpendicular to the reference axis, to the removal position of FIG. 6 wherein the locking member is parallel to the reference axis, the loop end portion 45 resiliently opens. The outer locking member 41 can also be maintained within the recess by a frictional engagement if the spindle is made round and the loop end portion fits tightly on the spindle.

Figure 6:
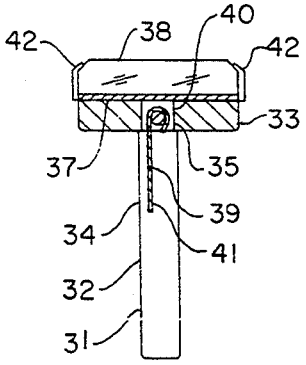
FIG. 6 is a cross-sectional view taken on the line 5—5 of FIG. 2, showing the ornamental member in condition for removal from the setting.
Figure 5:
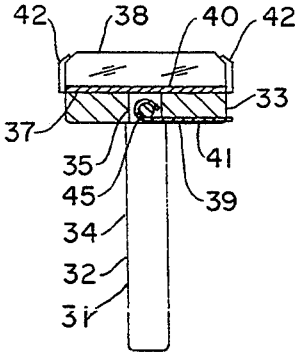
FIG. 5 is a cross-sectional view taken on the line 5—5 of FIG. 2, showing the ornamental member fixedly mounted on the setting.
Figure 4:
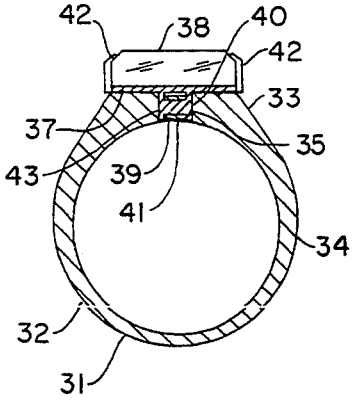
FIG. 4 is a cross-sectional view taken on the line 4—4 of FIG. 1.

When the locking member 41 is rotated to the position of FIG. 6, the ornamental member 32 is free to be detached from the setting 31. Thus, it is evident that if an article of jewelry is made in conformity with the present invention, one or more ornamental members can be simply and quickly interchanged on a setting by simply rotating the locking member 41 to a position of parallel relationship with the reference axis A—A, detaching the ornamental member 32 and installing, in reverse order of steps, a new ornamental member.

Referring now to FIGS. 12 through 15, inclusive, a simple and lower cost embodiment 46 is shown wherein an ornamental member 47 has a base 49 with a bendable flat blade portion 48 which extends outwardly for fixedly retaining the ornamental member 47 on a setting 50 and a gemstone 53 mounted on the base 49. The setting 50 has a narrow rectangular aperture 51 which closely conforms to the cross-section of the blade 48. The base is made of a soft malleable fatigue resistant material which will withstand repeated bending without failure.

It will be noted that this embodiment is equivalent to the previously described embodiment, since when the narrow blade 48 is inserted into the aperture 51 and the outer portion 52 of the blade 48 is bent into perpendicular relationship with the reference axis A—A, the inner portion 54 of the blade 48 is a locating portion lying entirely within the aperture 51 and parallel to the reference axis A—A and the outer portion 52 of the blade is a locking portion lying entirely outside the aperture 51 and perpendicular to the reference axis A—A.

In FIGS. 16 through 19, inclusive, a bracelet 55 is shown, which embodies my invention. The bracelet 55 has a setting 56 with the aperture 35 and an ornamental member 58 with the outward extending multi-piece retaining portion 39 for fixedly mounting the ornamental member 58 on the setting 56. The ornamental member 58 has a base 60 and a gemstone 61 mounted on the base 60.

In FIGS. 20 through 23, inclusive, a pendant type earring 62 is shown, which embodies my invention. The earring's pendant 63 has a setting 64 with the aperture 35 and an ornamental member 66 with the outward extending multi-piece retaining portion 39 for fixedly mounting the ornamental member 66 on the setting 64. The ornamental member 66 has a base 68 and a gemstone 69 mounted on the base 68.

Figure 24:
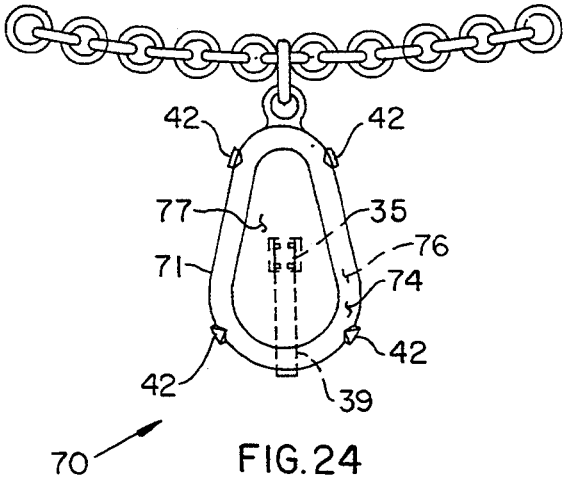
FIG. 24 is a front view of a necklace with a detachable ornamental member.
Figure 23:
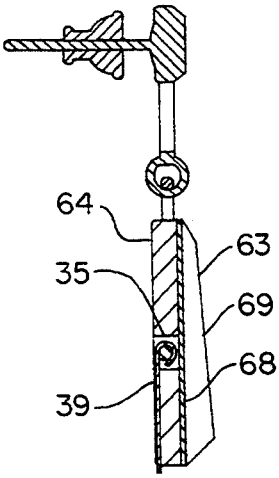
FIG. 23 is a cross-sectional view taken on the line 23—23 of FIG. 20.

In FIG. 24, a pendant type necklace 70 is shown, which embodies my invention. The necklaces's pendant 71 has a setting 72 with the aperture 35 and an ornamental member 74 with the outward extending multi-piece retaining portion 39 for fixedly mounting the ornamental member 74 on the setting 72. The ornamental member 74 has a base 76 and a gemstone 77 mounted on the base.

From the foregoing it will be appreciated that the present invention provides an attractive article of jewelry with interchangeable ornamental members having advantages heretofore unavailable and without the disadvantages of the prior art.

It is to be understood that various modifications can be made in my invention without departing from the spirit or the scope thereof. Accordingly, it is not my intention to limit my invention to the illustrations herein provided and the subject matter sought to be protected hereby should include the language of the claims and all equivalents thereof.

I claim:

1. An article of jewelry with a detachable ornamental member comprising: a setting which is adapted to be worn by a person, said setting having an aperture for receiving an ornamental member; the ornamental member detachably mounted on said setting, said ornamental member comprising a base, a gemstone mounted on said base, said base having a slender rectangular locating portion which is formed from the same piece as said base engaging said aperture for positioning said ornamental member on said setting, and a single locking portion attached to said locating portion and extending out of said aperture for retaining said ornamental member on said setting, said single locking portion being rotatable from a position which is aligned with said aperture for mounting and removing said ornamental member from said setting and being rotatable to a locking position which is non-aligned with said aperture.

2. The article of jewelry recited in claim 1 wherein said article is a ring.

3. The article of jewelry recited in claim 1 wherein said article is an earring.

4. The article of jewelry recited in claim 1 wherein said article is a bracelet.

5. The article of jewelry recited in claim 1 wherein said article is a necklace.

6. The article of jewelry recited in claim 1 wherein said locating portion is rectangular and said aperture is a rectangular aperture in the center of said setting.

7. The article of jewelry recited in claim 1 further comprising a recess in said setting for receiving said locking portion when said locking portion is in said locking position.

8. The article of jewelry recited in claim 7 further comprising a means for biasing said locking portion in said non-aligned relationship when said ornamental member is fixedly mounted on said setting.

9. The article of jewelry recited in claim 8 further comprising said locating portion of said ornamental member having a pair of outward extending flanges and a spindle fixed therebetween for rotatably mounting said single locking portion to said locating portion, said single locking portion comprised of a thin strip of resilient metal having a loop shaped end portion for engaging said spindle and said means for biasing said locking portion in said non-aligned relationship when said ornamental member is fixedly mounted on said setting comprising a frictional engagement of said loop shaped portion with said spindle.

10. The article of jewelry recited in claim 8 further comprising said locating portion of said ornamental member having a pair of outward extending flanges and an asymmetrical spindle fixed therebetween for rotatably mounting said locking portion to said locating portion, said locking portion comprised of a thin strip of resilient metal having an asymmetrical loop shaped end portion for engaging said spindle and said means for biasing said locking portion in said non-aligned relationship when said ornamental member is fixedly mounted on said setting comprising said engagement of said asymmetrical loop shaped portion with said asymmetrical spindle portion.

11. An article of jewelry with a detachable ornamental member comprising: a setting which is adapted to be worn by a person, said setting having an aperture for receiving an ornamental member; the ornamental member detachably mounted on said setting, said ornamental member having a slender rectangular locating portion engaging said aperture for positioning said ornamental member on said setting, and a single locking portion attached to said locating portion and extending out of said aperture for retaining said ornamental member on said setting, said single locking portion being rotatable from a position which is aligned with said aperture for mounting and removing said ornamental member from said setting and being rotatable to a locking position which is non-aligned with said aperture, said single locking portion of said ornamental member being formed from the same piece as said locating portion.

12. An article of jewelry with a detachable ornamental member mounted on a setting comprising: a setting which is adapted to be worn by a person, said setting having an aperture for receiving a slender locating portion of an ornamental member, the axis of said aperture defining an axis of reference; and the ornamental member detachably mounted on said setting, said ornamental member comprising a base and a decorative stone mounted on said base, said base having an outward extending slender portion for locating said ornamental member on said setting and a single locating portion which is formed from the same piece as said base and a separate locking portion which is rotatably mounted to said locating portion, said locating portion being in aligned relationship to said axis of reference and said single locking portion being rotatably adjustable to a position wherein said locking portion is in aligned relationship with said axis of reference for installing and detaching said ornamental member from said setting and rotatably adjustable to a locking position wherein said locking portion is in non-aligned relationship with said axis of reference for retaining said ornamental member on said setting.

13. An article of jewelry with a detachable ornamental member mounted on a setting comprising: a setting which is adapted to be worn by a person, said setting having an aperture for receiving a slender locating portion of an ornamental member, the axis of said aperture defining an axis of reference; and an ornamental member detachably mounted on said setting, said ornamental member comprising a base and a decorative stone mounted on said base, said base having an outward extending slender locking portion for retaining said ornamental member on said setting and a locating portion which is formed with said base from the same piece as said locking portion, said locating portion being in aligned relationship with said axis of reference and said locking portion being bendable to an unlocking position wherein said locking portion is in aligned relationship with said axis of reference for detaching said ornamental member from said setting and bendable to a locking position wherein said locking portion is in non-aligned relationship with said axis of reference for retaining said ornamental member on said setting.

14. An article of jewelry with a detachable ornamental member comprising: a setting which is adapted to be worn by a person, said setting having an aperture for receiving an ornamental member; the ornamental member detachably mounted on said setting, said ornamental member having a slender rectangular locating portion engaging said aperture for positioning said ornamental member on said setting, said locating portion of said ornamental member having a pair of outward extending flanges and a spindle fixed therebetween for rotatably mounting a single locking portion to said locating portion; and the single locking portion for retaining said ornamental member on said setting, said single locking portion being separate from and rotatably mounted to said locating portion and extending out of said aperture for retaining said ornamental member on said setting, said single locking portion being rotatable from a position which is aligned with said aperture for mounting and removing said ornamental member from said setting and being rotatable to a locking position which is non-aligned with said aperture.

* * * * *